US006109461A

United States Patent [19]

Kluge et al.

[11] Patent Number: 6,109,461

[45] Date of Patent: *Aug. 29, 2000

[54] SHELF MOUNTING SYSTEM INCLUDING MOUNTING BRACKETS HAVING MOUNTING EARS FOR MOUNTING VERTICAL TRACK MEMBERS TO A WALL

[75] Inventors: Richard G. Kluge, Bloomfield Township, Wis.; John R. Sterling, Woodstock, Ill.

[73] Assignee: John Sterling Corporation, Richmond, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/674,112

[22] Filed: Jul. 1, 1996

[51] Int. Cl.[7] ..... A47F 5/08

[52] U.S. Cl. ..... 211/90.01; 211/103; 211/187

[58] Field of Search ..... 211/90.01, 103, 211/187; 248/243, 248; 108/188, 47

[56] References Cited

U.S. PATENT DOCUMENTS

| | | | |
|---|---|---|---|
| 3,015,466 | 1/1962 | Levy | 211/187 X |
| 3,184,068 | 5/1965 | Wende | 211/103 X |
| 3,220,363 | 11/1965 | Gingher | 248/243 X |
| 3,631,821 | 1/1972 | Zachariou | 211/187 X |
| 4,138,019 | 2/1979 | Smith | 211/87.01 |
| 4,411,400 | 10/1983 | Everett | 108/47 X |
| 4,723,880 | 2/1988 | Stumpf | 211/87.01 X |
| 4,805,863 | 2/1989 | Armstrong et al. | 248/243 |
| 5,392,934 | 2/1995 | Fox | 211/94.01 |
| 5,485,932 | 1/1996 | Romm et al. | 211/103 X |

*Primary Examiner*—Daniel P. Stodola
*Assistant Examiner*—Gregory J. Strimbu
*Attorney, Agent, or Firm*—Rockey, Milnamow & Katz, Ltd.

[57] ABSTRACT

A shelf mounting system employing vertically oriented, elongated metal track members formed with parallel rows of laterally spaced slots for the attachment of cantilever and angle brace shelf support brackets thereto. The track members are detachably joined to hook mounting brackets for hanging the track members from a horizontal wooden sill member located along the upper end of a vertical wall. Alternatively face mounted brackets secured to the vertical wall are detachably secured to the track members. The face mounted brackets also are employed for hanging the track members from a floor or ceiling joist to support overhead mounted shelves.

5 Claims, 4 Drawing Sheets

SHELF MOUNTING SYSTEM INCLUDING MOUNTING BRACKETS HAVING MOUNTING EARS FOR MOUNTING VERTICAL TRACK MEMBERS TO A WALL

This invention is directed to improved shelf mounting systems and more particularly to improved multi-purpose hardware providing improved installation versatility.

BACKGROUND OF THE INVENTION

There are numerous shelf supporting systems available to the do-it-yourself market, largely dominated by the familiar wall mounted vertical metal rails having vertically spaced slot openings for reception of connector ends of metal cantilever shelf support brackets. Installation of such systems usually requires anchoring laterally spaced, vertical rails to vertical wall studs, connecting cantilever support brackets at corresponding levels along the length of the installed rails and placing shelves horizontally across such support brackets. Systems of this type for the most part largely are restricted to being anchored to vertical wall studs for proper support and once installed are more or less permanently located. Frequently, properly spaced wall studs are not available to meet the desired location demands of the shelving. In other instances masonry walls may be encountered, such as in a basement or garage, requiring special anchor systems for connecting the vertical rails to the walls, usually with considerable time and effort.

BRIEF SUMMARY OF THE INVENTION

Briefly the present invention provides an improved shelf mounting system comprising at least one pair of linear elongated track members formed with a generally U-shaped cross section to define parallel arms extending outwardly in like directions from a front wall thereof provided with parallel rows of spaced connector openings engageable with connector ends associated with cantilever or angle brace shelf supporting brackets. The track members also are detachably connected to anchor brackets having laterally spaced connector members insertably engageable with selected other connector openings of the track members. Means are provided on the anchor brackets for connection with a wooden top rail or sill plate at the upper end of a vertical wall or alternatively to laterally spaced vertical wall studs, intermediate wall frames or overhead wooden joist members or rafters.

It is an important object of this invention to provide a new and improved shelf mounting system wherein vertical, elongated track members are formed with plural spaced openings receptive of connector portions of shelf supports, as well as connector portions of mounting brackets operable for supporting the track members in stable operating positions.

It is a further object of this invention to provide a shelf mounting system, as set out in the preceding object, wherein vertical track members are detachably connected with brackets mounted over one face of a vertical wall or alternatively to brackets engageable with the walls upper end, or a sill plate associated with a masonry wall, for example.

Still another object of this invention is to provide a shelf mounting system having novel hardware for mounting bracket supported shelves horizontally on a vertical wall independently of wall studs.

A still further object of this invention is to provide a shelf mounting system employing vertical metal tracks and adjustable shelf supports which is adapted for suspending shelves from overhead wooden joists or rafters.

Having described this invention, the above and further objects, features and advantages thereof will appear from time to time from the following detailed description of a preferred embodiment thereof illustrated in the accompanying drawings and representing the best mode presently contemplated for practicing this invention.

IN THE DRAWINGS

DESCRIPTION OF THE PREFERRED EMBODIMENT

Figure 1:
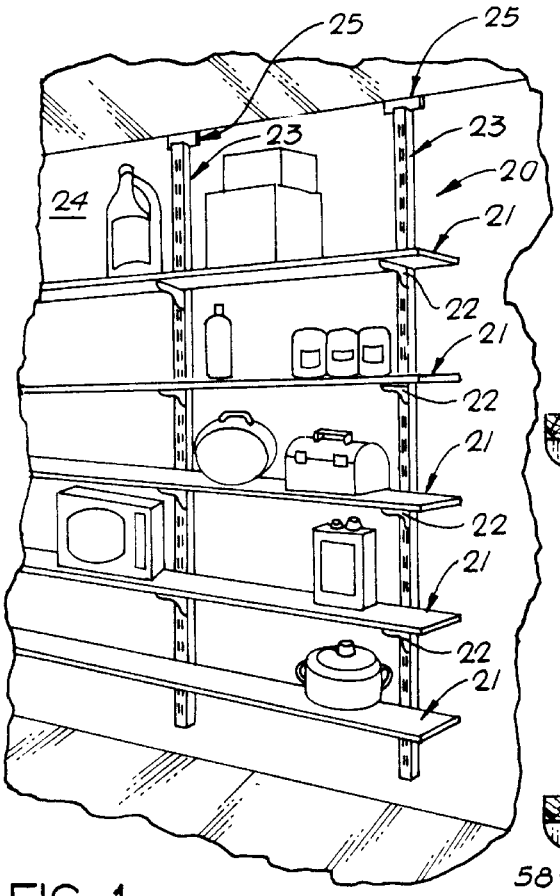
FIG. 1 is a partial perspective view of a cantilever mounted shelving system in accordance with this invention wherein parallel vertical track members are hung from the top plate of a finished interior wall.
Figure 2:
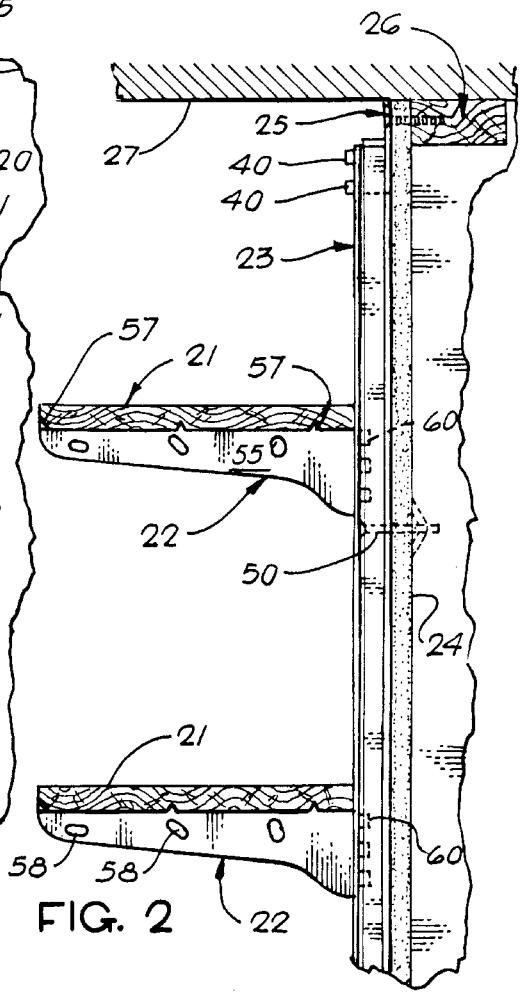
FIG. 2 is an enlarged partial side elevational view of the shelf assembly of FIG. 1 illustrating the interconnection of a vertical slotted track member and associated hanger bracket.
Figure 3:
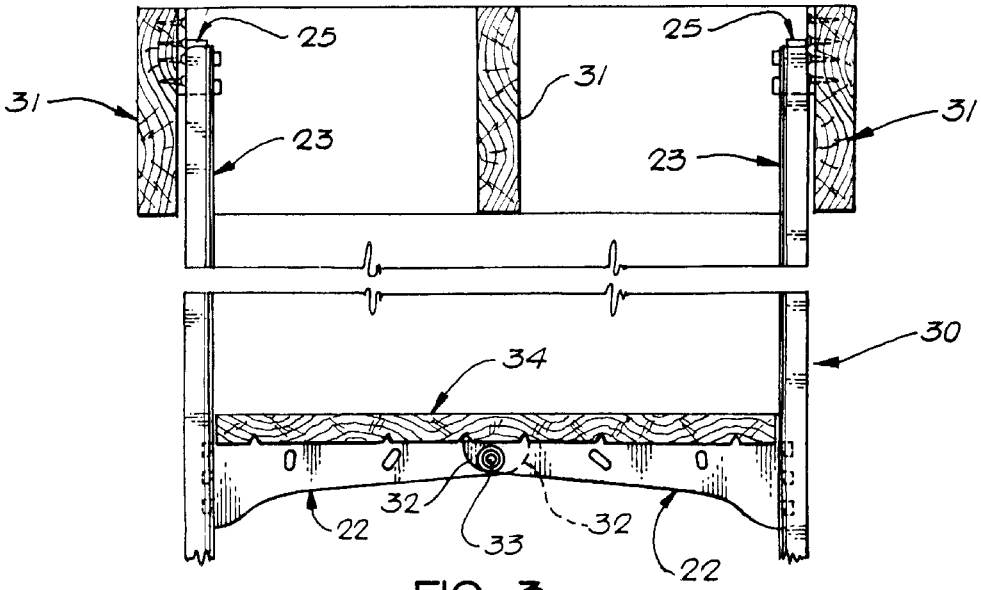
FIG. 3 is a foreshortened side elevational view of an alternate installation of this invention employing wall mounting brackets shown in FIGS. 1 and 2 to anchor opposing pairs of vertical track members to overhead floor or ceiling joists and rafters.

Turning now to the drawing FIGS. 1–3, two examples of this invention are illustrated. As shown in FIGS. 1 and 2, the shelving system indicated generally at 20 thereat comprises a plurality of horizontal shelves 21 supported on cantilever support brackets 22 extending from parallel spaced vertical track members 23 of a generally U-shaped cross section which are mounted on a vertical partition wall 24. Surface mounting brackets 25, attached to a top sill or plate 26 of wall 24 adjacent ceiling 27 serve to support the track members in vertical parallelism; the latter being detachably assembled with brackets 25.

A modified overhead shelf installation 30 is illustrated in FIG. 3 wherein opposed track members 23 are attached at their upper ends to face mounting brackets 25 anchored overhead to spaced floor joists or ceiling rafters 31, 31 such as are present in a basement or garage for instance. Opposing cantilever shelf support brackets 22, 22 have their opposing end portions 32 overlapped which are fastened together by bolt means 33 or similar fasteners to provide a rigid horizontal support for an overlying shelf 34.

Details of the hardware involved in the two illustrated installations 20 and 30 of FIGS. 1–3 will best be understood with reference to FIGS. 7–13 as now will be described.

As shown in FIGS. 7, 8, 11, 12 and 13, each surface mount bracket 25 comprises a planar metal body of generally T-shaped configuration having a cross head portion of the T-shape, indicated at 36, of rectangular shape and provided with three fastener openings 37 therethrough which are arranged in staggered relationship for the acceptance of fastening screws or the like. A co-planar stem portion of the T-shape, indicated at 38, extends at right angles from the mid-region of the cross head portion 36 and like the latter also has spaced fastener openings 37 therethrough (see for hanging the track members from floor or ceiling joist to FIG. 11), receptive of screws for anchoring the brackets 25 against wall 24.

Figure 7:
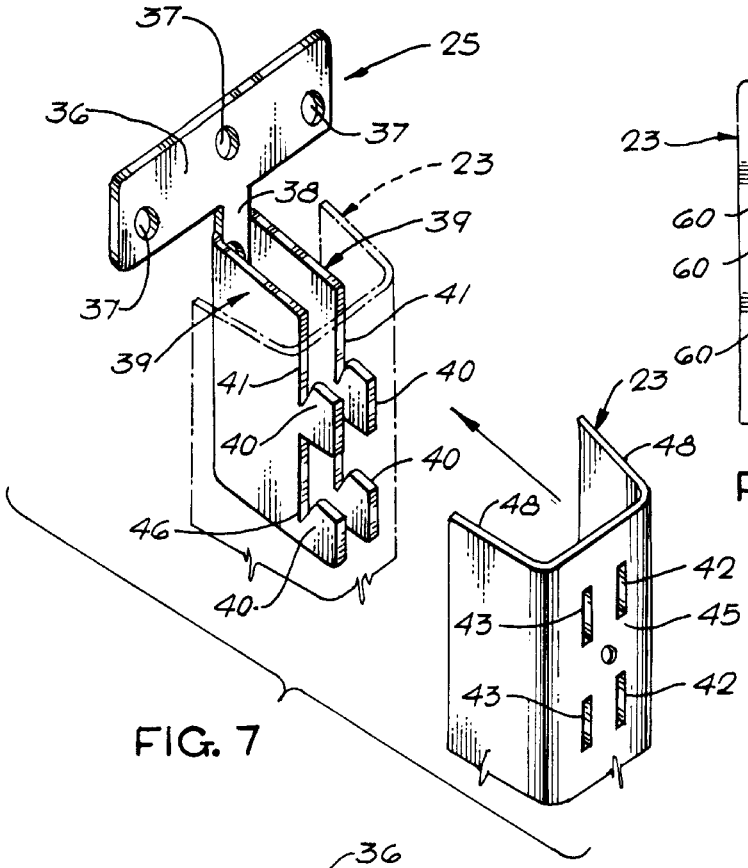
FIG. 7 is an exploded perspective view, similar to FIG. 6, illustrating the relationship of the face mount bracket illustrated in FIGS. 1–3 of the drawings and a vertical track member.

It will be noted that the lateral margins of stem portion 38 are integral with two parallel spaced planar mounting arms 39, 39 extending outwardly at right angles from the front face of the stem portion 38 (see FIG. 7). Each of the arms 39 is formed with a pair of vertically spaced mounting ears 40, 40 extending upwardly from a leading edge 41 thereof. As indicated by the phantom line position of the track member 23 in FIG. 7, ears 40 are arranged to enter adjacent pairs of laterally spaced openings 42 and 43 of parallel rows of like openings formed in the front wall 45 of an associated track member whereby to detachably interconnect each bracket 25 with an associated track member 23.

Importantly, it will be recognized that ears 40 are partially separated from their associated mounting arms 39 by downwardly elongated wedge shaped entry openings 46 which merge with edges 41 of the arms 39. Such openings 46 receive the front wall 45 of the track member in assembly to produce a tight wedging action therebetween particularly when the track members 23 are vertically loaded. Separated parallel spacing of the arms 39 serves to laterally stabilize the track members securely on the brackets 25 while the wedging action produced by the wedge shaped openings 46 pushes the side arms or walls 48, 48 of the track members toward wall 24.

While the two installations shown in FIGS. 1 and 2 respectively relate to situations where the brackets 25 are attached to one edge of the top plate or sill 26 of a partition wall 24 with the upper ends of the track members being coupled to the brackets 25, it is fully contemplated that such interconnection of the track members and brackets may occur at any selected location along the length of the track members depending on the mounted position of the brackets 25 and availability of satisfactory anchor support therefor, such as a vertical wall stud or a horizontal wall brace.

If desired, auxiliary wall anchoring fasteners may be employed in the shelf installation 20, such as indicated at 50 in FIG. 2 of the drawings, although such an option is not required for the successful operation and stability of the mounting system of this invention. For example, the brackets 25 successfully stabilize vertical track members 23 in operation as demonstrated by the overhead installation of FIG. 3.

Figure 8:
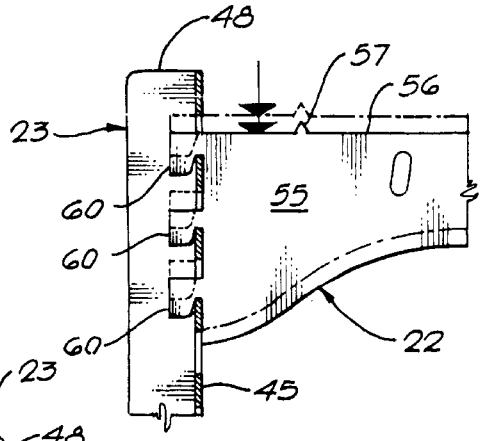
FIG. 8 is a partial, enlarged side elevational view showing a cantilever shelf supporting bracket connected to a vertical track member shown in longitudinal cross section.
Figure 9:
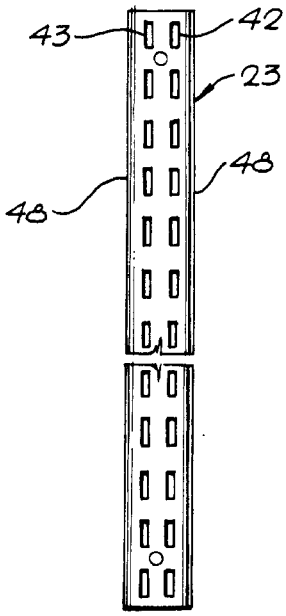
FIG. 9 is a foreshortened front elevational view of a track member in accordance with this invention illustrating the front wall thereof and pairs of parallel slotted openings therein.
Figure 13:
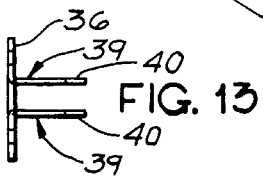
FIG. 13 is a top plan view of the bracket shown in FIGS. 11 and 12.
Figure 11:
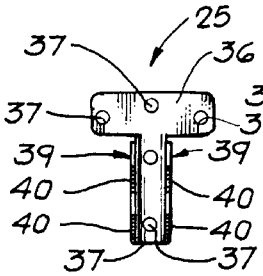
FIG. 11 is a front elevational view of the face mounting bracket shown in FIG. 7.
Figure 12:
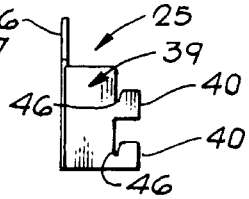
FIG. 12 is a side elevational view of the FIG. 11 bracket.
Figure 16:
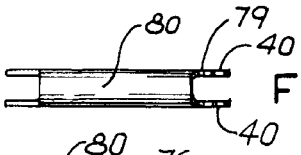
FIG. 16 is a top plan view of the bracket shown in FIG. 14.
Figure 14:
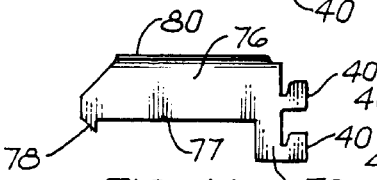
FIG. 14 is a side elevational view of the top mounting bracket shown in FIGS. 4–6.
Figure 15:
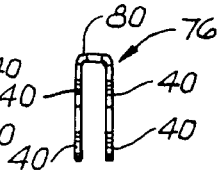
FIG. 15 is a rear end elevational view of the bracket shown in FIG. 14.
Figure 10:
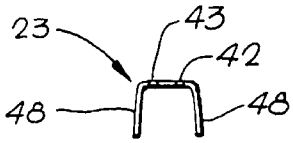
FIG. 10 is a top plan view of the track member shown in FIG. 9.

Aside from the hardware items discussed hereinabove, the actual support of the shelves 21 requires cantilever support brackets 22 which are attached at selected locations along the mounted track members in accordance with the desired shelf spacing. As best shown in FIG. 8, each cantilever bracket 22 comprises a planar shelf support arm 55 having a linear upper edge 56 on which a shelf 21 rests. It will be recognized that edge 56 of the support arm preferably is formed with one or more upwardly projecting sharp points 57 adapted to penetrate the underside of a wooden shelf 21 and thereby prevent unwanted movement of the shelving in operation (see FIG. 2). The cantilever shelf support arms further preferably are formed with one or more holes 58 along the length thereof to reduce weight and provide openings for the passage of suitable connectors, such as the bolts 33 used in the overhead installation 30 of FIG. 3.

In order to attach the brackets 22 to a vertical track member 23, as in the FIG. 2 installation, each support arm 55 is formed with two or more vertically spaced mounting ears 60 projecting outwardly from the inner ends thereof. In the illustrated embodiments hereof preferably there are three such mounting ears 60 on each cantilever bracket. It will be noted, that while ears 60 are formed with the same configuration as ears 40 of bracket 25 they are oppositely directed from ears 40, i.e., they extend downwardly toward the lower side of the cantilever brackets so that they operationally hook over the lower edges of the slots 42 or 43 in the track members. Ears 60 are introduced into the slotted openings 42 or 43 from the front side of wall 45 of the track members as opposed to passage of the mounting bracket ears 40 which enter the slots 42 and 43 from the rearward side the track member wall 45. As with ears 40, the mounting ears 60 associated with the cantilever support brackets provide a wedging action to interlock with the vertical track members; such action increasing with the downward vertical load imposed on the shelves 21 (see FIG. 8).

Figure 4:
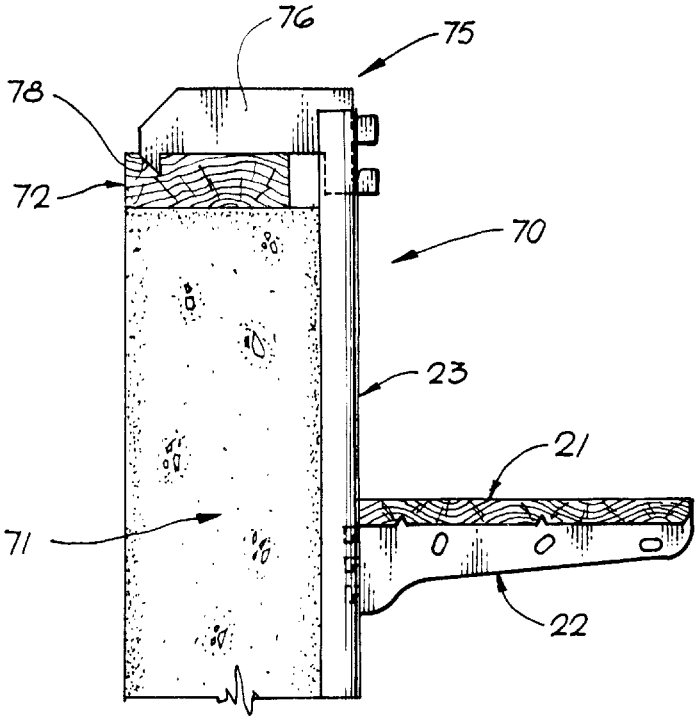
FIG. 4 is a partial side elevational view, similar to FIG. 2 of the drawings, illustrating an alternate mounting bracket for use with either sill or top plates of masonry walls or room dividing partitions wherein the mounting bracket extends partially over the wall's upper end and engages the sill or top plate of the wall.
Figure 5:
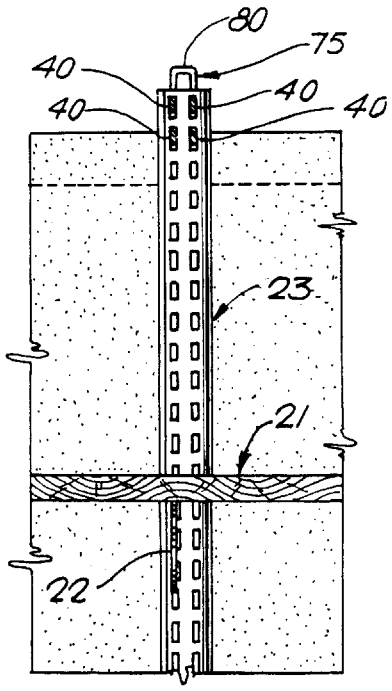
FIG. 5 is a partial front elevational view of the assembly shown in FIG. 4.

It will be recalled that one of the features and objects of the mounting system of this invention is its ability to hang mounting tracks from the top sill or plate of a vertical wall such as an interior partition wall of a room or a masonry wall as would be encountered in a basement, for example. In the assembly 20 of FIGS. 1 and 2, as described hereinabove, the track members are hung from one edge of a top plate 26 of an interior partition wall by means of the face mounting brackets 25. In FIGS. 4–6 and 14–16 the features of hardware for suspending the track members from the top side of sill plate of a masonry wall or from an interior partition that is not ceilinged over, is illustrated. As shown in FIGS. 4 and 5, such an alternate shelf mounting system especially adapted for interior partition walls or masonry walls is indicated generally at 70 thereat. This system comprises vertical track members 23, the horizontal shelving 21 and cantilever shelf support brackets 22 all as previously described. In addition it will be noted that system 70 is related to a masonry wall 71 in the illustrated case hereof; such a wall typically occurring in a basement having a conventional wooden sill plate 72 extending along its upper end. According to conventional practice, track members 23 normally would be anchored directly to one face of such a masonry wall 71 by drilling appropriate fastener receptive sockets in the wall and mounting suitable anchoring devices therein receptive of threaded screws or bolts passing through the track members for anchoring the latter to the wall. However, in order to obviate such a procedure according to the features of this invention, an improved top mounting bracket assembly 75 is provided.

Figure 6:
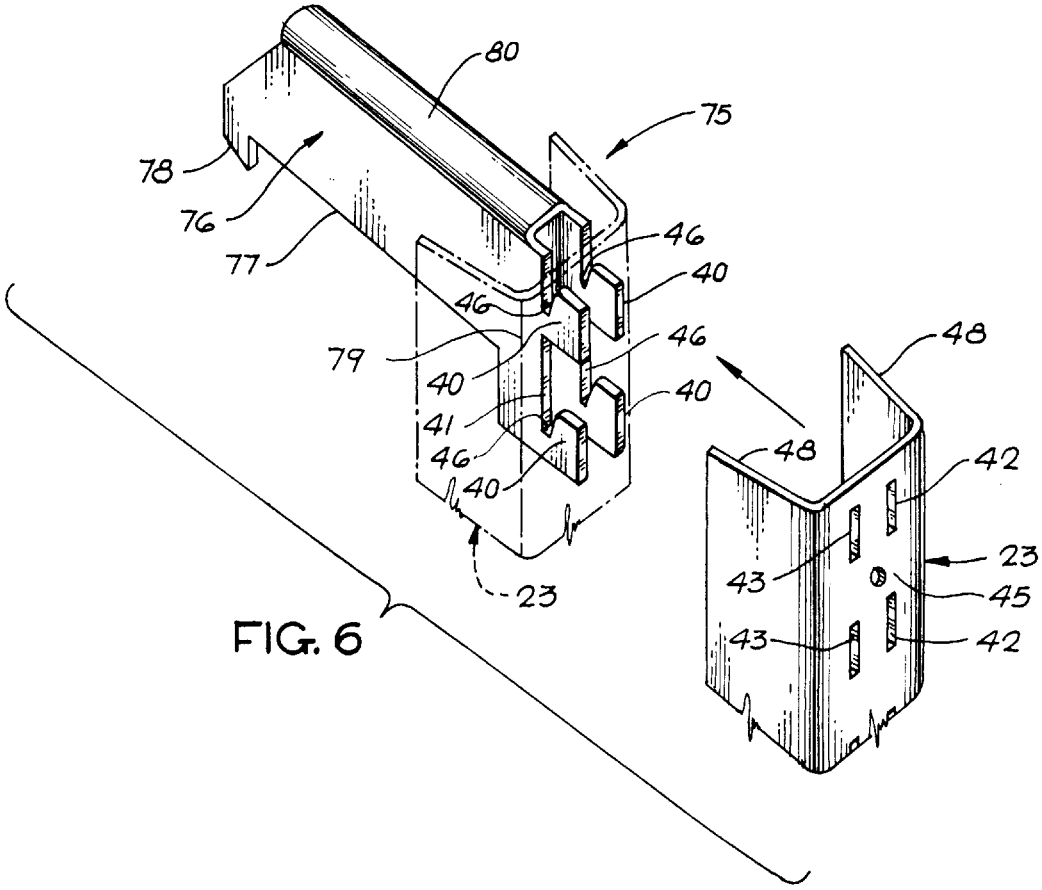
FIG. 6 is an exploded perspective view showing a foreshortened section of the track member of FIG. 5 and illustrating the structural arrangement and assembly of the track member and mounting bracket shown in FIGS. 4 and 5.

As shown best in FIGS. 4 and 6, assembly 75 comprises a unitary metal attachment member formed with two identical planar arms 76 of generally elongated, rectangular shape distinguished by a straight bottom edge 77 having a downwardly extending prong or hook 78 adjacent one outer end thereof. The opposite end of each arm 76 is formed with a planar, axially extended portion 79 having pairs of upstanding mounting ears 40, 40 along one leading edge 41 thereof just as in the previously described face mounted bracket 25 of FIGS. 1 and 2.

Uniquely the two bracket arms 76 are aligned registeringly and in lateral spaced parallelism with the prongs 78 thereon pointing downwardly. A transverse top wall 80 bridges the upper ends or edges of the arms 76 to integrate them into a unitary structure of substantially U-shaped cross section (see FIG. 15). Arms 76 are spaced laterally so that the mounting ears 40, 40 thereon are registeringly aligned with the slotted openings 42 and 43 in an associated track member 23 whereby to interconnect each bracket and track member in the same manner as in the described face mounted bracket 25 and its assembly with the track member 23. It is to be noted that in order for the assembly 75 to effectively anchor the track members the prongs or hooks 78 at the lower outer ends of arms 76 preferably engage and penetrate the sill plate 72 or the upper end of wall 71 if there is no sill plate while the track member 23 closely hugs an outer face of wall 71. This arrangement serves to maintain the assembly 70 in place, with the weight of the track members and the subsequent load on shelves 21 serving to maintain the hooks 78 firmly engaged. Once the brackets 75 and the track members 23 are assembled, mounting of the cantilever support brackets 22 and shelves 21 on the track members is carried out in the manner described hereinabove.

In certain instances, heavy loads need to be supported on shelves 21. For that purpose, heavy duty brackets 85 as shown in FIG. 17–24, may be substituted for the above described cantilever brackets 22.

Figure 17:
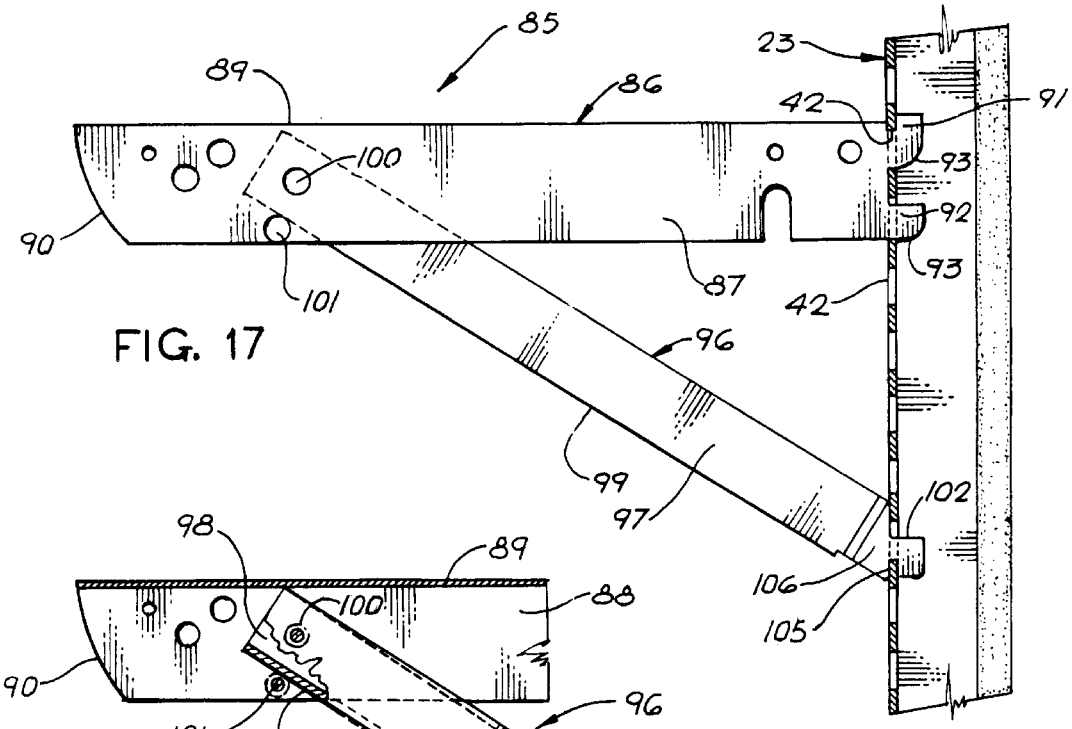
FIG. 17 is a side elevational view of a heavy duty shelf support. bracket and vertical support.
Figure 18:
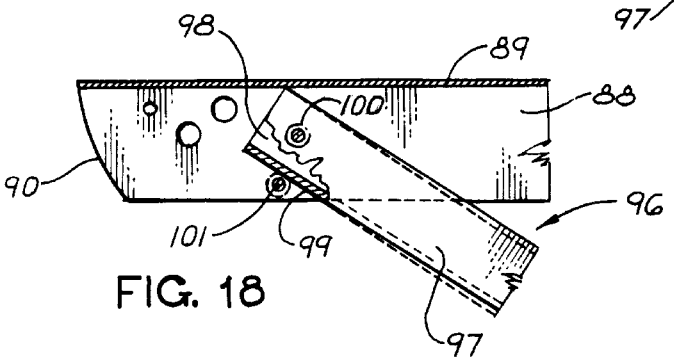
FIG. 18 is a partial foreshortened sectional view of the bracket shown in FIG. 17, taken substantially its longitudinal central axis.

As will be recognized from FIGS. 17 and 18 in particular, each bracket 85 is disposed to cooperate with parallel spaced vertical tracks 23 each having pairs of slotted openings 42, 43 disposed in parallel rows, all as previously related (see FIG. 5, 6 and 7). The bracket 85 has a shelf supporting arm 86 which preferably is formed of heavy gauge metal suitably bent and formed to provide a pair of parallel spaced side walls 87 and 88 interjoined by a transverse integral top wall 89 so that the arm has an inverted U-shaped cross section in operation. The outer or leading end of each of the walls 87, 88 may be formed with a curved end edge 90, as shown. The opposite or operationally inner end of the walls 87, 88 are each formed with an upstanding hook ear 91 adjacent its upper end and a straight connector ear 92 adjacent the bottom edge thereof. Both ears are distinguished by a curved lower corner 93 to provide clearance to the connector ears as they enter slots 42 and 43 when mounting a bracket 85 to the vertical track member 23.

To support the arm 86, a suitable angle brace 96 is provided which, like arm 86 is formed with a pair of parallel spaced planar side walls 97, 98 cross connected at their lower margins by transverse bottom wall 99 (see FIG. 18). The resulting structure is substantially U-shaped in cross section with walls 97, 98 being laterally spaced to closely fit between walls 87 and 88 of the support arm 86. Adjacent the outer ends of the two walls 97, 98 is a single hole (unnumbered) receptive of a rivet 100 which also extends through walls 87 and 88 of the support arm to pivotally join brace 96 with arm 86. Clockwise pivotal movement of the brace may be limited by an optional second rivet 101 extending between the support arm walls 87, 88 to engage the bottom edges of brace walls in the manner best shown in FIG. 18.

At the inner end of each of the brace arm walls 97, 98, is a single downwardly facing hook ear 102 insertible into an appropriate slotted opening 42 or 43 so as to embrace the front wall 45 of the vertical track member and provide stable undersupport for the shelf supporting arm 86. It will be noted that the brace 96 is disposed at substantially 30° to the longitudinal axis of the shelf support arms 86 when connected to the track member 23. To accomplish this, the hook ear 102 extends at right angles to an inclined end face 105 of a triangular end portion 106 extending from the outer end of each wall 97, 98; the end face 105 lying at substantially 30° to the lengthwise axis of the brace 96 with the two ears 102 on walls 97 and 98 being registeringly aligned. It further will be noted that each hook ear has a notch 107 extending inwardly of its lower edge (see FIG. 19) for closely receiving the front wall 45 of the vertical track therein (see FIG. 23).

Figure 19:
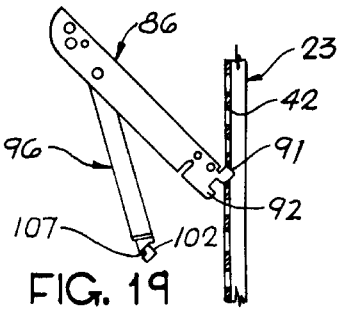
FIGS. 19, 20 and 21 are side elevational views of the bracket and vertical support shown in FIG. 17, at a reduced scale thereover, illustrating successive steps of attaching the bracket to the vertical support.
Figure 20:
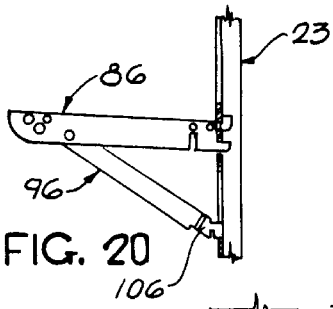
Figure 21:
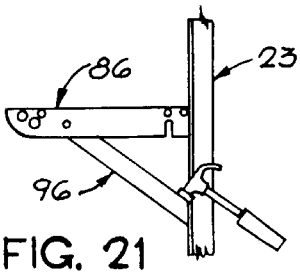
Figure 22:
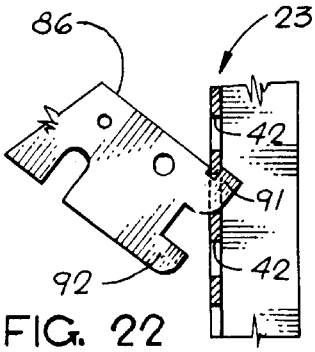
FIG. 22 is a partial enlarged sectional view, corresponding to the upper portion of FIG. 19, illustrating the initial step of attaching the shelf support arm of the bracket to the vertical support.
Figure 23:
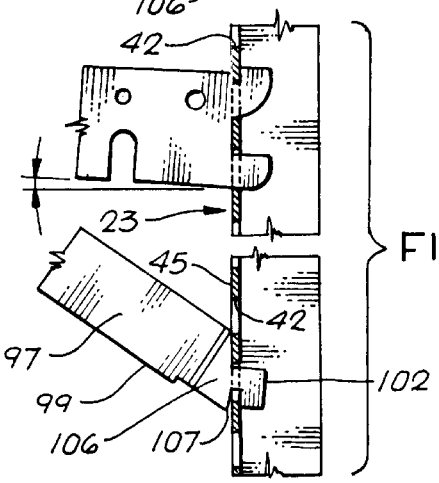
FIG. 23 is an enlarged foreshortened sectional view corresponding to FIG. 20, illustrating the intermediate step of attaching the shelf support arm and angle brace of the bracket to the vertical support.
Figure 24:
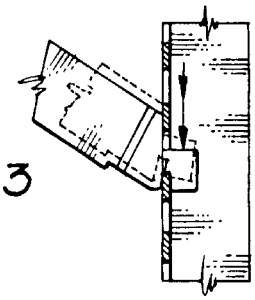
FIG. 24 is an enlarged sectional view, of the lower portion of FIG. 21, illustrating the step of locking the angle brace to the vertical support.

With reference to FIGS. 19–21 the procedure for mounting a heavy duty bracket 85 to an upright track 23 will be apparent.

As shown in FIG. 19 initial engagement between the arm 86 and track 23, is by inserting upper ears 91 of the shelf support arm 86 into a corresponding pair of the slotted openings 42, 43 of the track member. Thereafter arm 86 is pivoted downwardly (counterclockwise in FIG. 19) until the lower ears 92 of the walls 87 and 88 are aligned for entry into an adjacent pair of the track openings 42, 43 (see FIG. 22). The radiused lower corners 93 of the ears 91 and 92 provide appropriate clearance between the ears and slots 42 and 43 to permit the aforenoted pivotal entry movement of the support arm 86.

Simultaneously with the entry of the straight connecting ears 92 into their respective openings of the track 23, the angle brace 96 has its pair of hook ears 102 engaged with a pair of slotted track openings 42, 43 as indicated in FIGS. 20 and 23. Once ears 102 are fully inserted in the track openings the brace arm is pivoted downwardly to lock tightly with the front wall 45 of the track member. This locking action may be assisted by striking the brace 96 with a hammer as illustrated in FIG. 21, thus forcing slot 107 of the hook ear 102 downwardly over front wall 45 of the track member 23. This results in a very positive interconnection of the bracket. 85 with the vertical track members to provide a very secure shelf support adapted to carry heavy loads in the order of 300 lbs. per bracket.

From the foregoing it is believed that those familiar with the art will readily recognize and understand the novel advancement of this invention over the prior art and will appreciate that while the same is herein been described in association with a preferred embodiments thereof illustrated in the accompanying drawings the same is susceptible to modification, variation and substitution of equivalents without avoiding the invention which is intended to be unlimited by the foregoing except as may appear in the following appended claims.

The embodiments of the invention in which an exclusive property or privilege is claimed are defined as follows:

1. A shelf mounting system for mounting shelves on a generally vertical wall, said system comprising:

a pair of parallel, horizontally spaced apart vertical track members, each of said track members being generally U-shaped in cross section and having a front wall and two side walls, said two side walls of each said track member extending from a front face of said front wall and define a channel with a rear face of said front wall, said front wall of each said track member having a row of vertically spaced slots extending therethrough, a pair of mounting brackets adapted to be mounted on the wall, each said mounting bracket comprising a mounting arm and a mounting ear extending upwardly from said mounting arm, each said mounting bracket adapted to be inserted in the channel of a respective one of said track members with said ear extending from said rear face of said respective one of said track members through a respective one of said slots to support said respective one of said track members with respect to the wall such that said respective one of said track members substantially abuts the wall; and a pair of cantilever shelf support brackets each including a shelf support arm and at least one mounting ear extending downwardly from the shelf support arm, each said shelf support bracket adapted to be mounted on a respective one of said track members such that said mounting ear of said shelf support bracket extends from said front face of said respective one of said track members into another one of said slots thereof.

2. A shelf mounting system in accordance with claim 1, wherein each of said track members includes a second row of vertically spaced slots extending through said front wall thereof and spaced laterally from said aforementioned row of vertically spaced slots, each of said mounting brackets including a second mounting arm spaced laterally from said aforementioned mounting arm and including a mounting ear extending upwardly therefrom, said mounting ear of each of said second mounting arms being insertable into a respective one of said slots of said second row of vertically spaced slots.

3. A shelf mounting system in accordance with claim 2, wherein each said mounting bracket comprises a planar body from which said pair of mounting arms extend outwardly therefrom, each said planar body including a plurality of fastener openings extending therethrough.

4. A shelf mounting system in accordance with claim 2, wherein each said mounting arm includes a downwardly extending prong on an end of said arm opposite a respective one of said mounting ears.

5. A shelf mounting system in accordance with claim 1, wherein said mounting ear of each said mounting bracket defines a wedge shaped opening with said mounting arm, and said mounting ear of each said shelf support bracket defines a wedge shaped opening with said shelf support arm.

* * * * *